US008435364B2

(12) United States Patent
Stevenson, III et al.

(10) Patent No.: US 8,435,364 B2
(45) Date of Patent: May 7, 2013

(54) HYPERGOLIC LIQUID OR GEL FUEL MIXTURES

(75) Inventors: William H. Stevenson, III, Huntsville, AL (US); LaShanda D. Felton, Huntsville, AL (US); Zhu Slocum-Wang, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 83 days.

(21) Appl. No.: 13/189,874

(22) Filed: Jul. 25, 2011

(65) Prior Publication Data

US 2011/0272071 A1 Nov. 10, 2011

Related U.S. Application Data

(62) Division of application No. 11/564,990, filed on Nov. 30, 2006, now abandoned.

(51) Int. Cl.
*C06B 23/00* (2006.01)

(52) U.S. Cl.
USPC ..... 149/1

(58) Field of Classification Search ..... 149/1, 109.6
See application file for complete search history.

(56) References Cited

U.S. PATENT DOCUMENTS 3,490,237 A * 1/1970 Lissant ..... 60/217
5,133,183 A 7/1992 Asaoka et al.
6,013,143 A 1/2000 Thompson
6,210,504 B1 4/2001 Thompson
6,299,654 B1 10/2001 Thompson
6,949,152 B2 9/2005 Hallit et al.
6,962,633 B1 11/2005 McQuaid

OTHER PUBLICATIONS

Z.Slocum-Wang, L.D. Felton, T.W. Turner, W.H. Stevenson, III, Ignition Delay Screening Techniques: Drop Testing vs. Engine Testing, 2nd Liquid Propulsion, 1st Spacecraft Propulsion Subcommittee, Dec. 5-8, 2005, JSC CD-43, Chemical Propulsion Information Analysis Center, Columbia, MD 21044-3286.

* cited by examiner

*Primary Examiner* — Aileen B Felton
(74) *Attorney, Agent, or Firm* — William B. Haymond

(57) ABSTRACT

Hypergolic liquid or gel fuel mixtures utilized in bipropellant propulsion systems are disclosed as replacements for fuels containing toxic monomethylhydrazine. The fuel mixtures include one or more amine azides mixed with one or more tertiary diamine, tri-amine or tetra-amine compounds. The fuel mixtures include N,N,N',N'-tetramethylethylenediamine (TMEDA) mixed with 2-N,N-dimethylaminoethylazide (DMAZ), TMEDA mixed with tris(2-azidoethyl)amine (TAEA), and TMEDA mixed with one or more cyclic amine azides. Each hypergolic fuel mixture provides a reduced ignition delay for combining with an oxidant in fuel propellant systems. The fuel mixtures have advantages in reduced ignition delay times compared to ignition delay times for each unmixed component, providing a synergistic effect which was not predictable from review of each component's composition. Additional fuel mixtures include various tertiary diamine, tertiary tri-amine or tetra-amine compounds combined with one or more amine azides or imidic amide compounds, to provide clean burning, high performing, and non-toxic fuels.

19 Claims, 7 Drawing Sheets

% DBM Relative to PMDETA

HYPERGOLIC LIQUID OR GEL FUEL MIXTURES

CROSS-REFERENCE TO RELATED APPLICATIONS

The present application is a divisional of application Ser. No. 11/564,990 which was originally filed on Nov. 30, 2006.

STATEMENT REGARDING FEDERALLY SPONSORED RESEARCH OR DEVELOPMENT

The invention described herein may be manufactured, used and licensed by or for the Government for governmental purposes without the payment to the inventors and/or the assignee of any royalties thereon.

BACKGROUND OF THE INVENTION

1. Field of the Invention

The present invention relates to fuel mixtures utilized in hypergolic propulsion systems. More specifically, the invention relates to hypergolic fuel mixtures of tertiary amines and amine azides, or amines and imidic amides.

2. Description of the Related Art

A liquid or gel bipropellant rocket propulsion system consists of gas generators, oxidizer and fuel propellant tanks, plumbing, oxidizer and fuel valves, and an engine. The bipropellant rocket propulsion unit begins operation when the gas generators have been initiated and the gases from the gas generator pressurize oxidizer and fuel propellant tanks. When the oxidizer and fuel valves open, the pressurized oxidizer and fuel tanks then force the propellants through the plumbing into the engine where the propellants are mixed and ignited. The propellants can be ignited by either ignition aids or by hypergolic (spontaneously self-igniting) chemical reaction. Since ignition aids can take up valuable space in the propulsion system, a hypergolic chemical reaction is the preferred ignition method. Inhibited red fuming nitric acid (hereinafter, IRFNA) and monomethyl hydrazine (hereinafter, MMH) have been the preferred hypergolic rocket oxidizer and fuel for rocket propulsion systems for some time, by providing a high specific impulse and density specific impulse, and providing a short ignition delay of approximately 3 milliseconds or less to approximately 15 milliseconds (depending on test techniques), before ignition after combining of an oxidizer and MMH. A short ignition delay characteristic is important since a long ignition delay of approximately 25 millisecond or longer causes fuel and oxidizer to accumulate in the combustion chamber, so that when ignition does take place an overpressurization can occur with creation of a "hard start." Overpressurization in the combustion chamber can be severe enough to destroy the rocket motor and negate achievement of the mission objective.

A main drawback of MMH is the high toxicity of the compound. Classified as a suspected human carcinogen, MMH requires exceptional safety precautions during handling which makes fueling of rocket motors both time consuming and expensive. A non-carcinogenic alternative to MMH which can be readily utilized in hypergolic bipropellant propulsion systems is preferred.

U.S. Pat. No. 6,013,143, issued to D. M. Thompson and assigned to the Secretary of the Army, discloses liquid or gel bipropellant fuel compounds which are alternatives to use of potentially carcinogenic compound MMH in rocket propulsion systems similar to a system illustrated in U.S. Pat. No. 5,133,183. The hypergolic fuel compounds disclosed in the '143 patent include three tertiary amine azide compounds consisting of 2-N,N-dimethylaminoethylazide (identified as DMAZ), bis(ethyl azide) methylamine (identified as BAZ), and pyrrolidinylethylazide (also identified as 2-(N-pyrrolidinyl)ethylazide, or PYAZ). The '143 patent disclosed that use of MMH as a fuel mixture with IRFNA would deliver a specific impulse of 284 lbf sec/lbm and a density impulse of 13.36 lbf sec/cubic inch. Under similar operating conditions, DMAZ delivered a specific impulse of 287 lbf sec/lbm and a density impulse of 13.77 lbf sec/cubic inch. To achieve performance comparable to MMH used in a rocket propulsion system, the '143 patent disclosed each one of the tertiary amine azides (DMAZ, BAZ or PYAZ) were combined with an oxidizer selected from the group of oxidizers consisting of IRFNA, nitrogen tetroxide, hydrogen peroxide, hydroxyl ammonium nitrate, and liquid oxygen. The '143 patent did not disclose alternative oxidizer compounds which may provide similar or improved performance when combined with DMAZ, BAZ or PYAZ. A limitation of the compounds disclosed in the '143 patent included, for each of the three hydrocarbon moieties attached to the tertiary amine, that at least one but no more than two moieties contained an azide group. A further limitation of the '143 patent includes the tertiary amine azide molecule can have no more than seven carbon atoms for the compound to remain hypergolic, allowing the tertiary amine azides to produce adequate specific impulse or density specific impulse results when mixed with IRFNA.

U.S. Pat. No. 6,210,504, issued to D. M. Thompson and assigned to the Secretary of the Army, discloses a gas generator fuel source for a liquid or gel gas generator system, including the three tertiary amine azide compounds disclosed in the '143 patent, specifically DMAZ, BAZ, and PYAZ. The '504 patent discloses that any one of the three tertiary amine azide compounds is contained and heated in an iridium catalytic reactor bed to achieve a self sustaining decomposition reaction to yield gaseous products for pressurization of the liquid or gel gas generator system. The '504 patent does not disclose alternative tertiary amine azide compounds which may provide similar or improved performance when used instead of, or in combination with DMAZ, BAZ or PYAZ. Limitations of the structure and radicals attached to the tertiary amine azide compounds are relevant to the '504 patent as also disclosed in the '143 patent. The '504 patent discloses solid additives and gellant additives consistent with the additives disclosed in the '143 patent, including use of a gallant such as silicon dioxide, clay, carbon, and polymeric gallant.

It is desirable to provide a plurality of hypergolic fuel mixtures exhibiting minimal toxicity, classified as a non-carcinogen, and having a short ignition delay when mixed in a propulsion system. It is also desirable to provide a plurality of fuel mixtures having a short ignition delay and a density specific impulse competitive with MMH fuel. It is further desirable to provide a plurality of hypergolic fuel mixtures containing a tertiary diamine, tertiary tri-amine or a tetra-amine compound, any of which is mixed with an amine azide compound, a monocyclic amidine compound, or a multi-cyclic amidine compound, for use in propulsion systems as replacements for MMH fuel.

BRIEF SUMMARY OF THE INVENTION

A fuel mixture is disclosed for use as hypergolic liquid or gel fuel in bipropellant propulsion systems, with the chemical compounds preferably having similar ignition characteristics as MMH, and preferably the compounds not being toxic or classified as a suspected human carcinogen. One compound disclosed includes N,N,N',N'-tetramethylethylenediamine (hereinafter, TMEDA), a tertiary diamine, mixed with any one of a family of hypergolic amine azides, with one compound being DMAZ. Laboratory test data for TMEDA provides an ignition delay of approximately 14 milliseconds, and laboratory test data for DMAZ provides an ignition delay of approximately 26 milliseconds. Combination of TMEDA and DMAZ in a hypergolic liquid or gel fuel provides an unexpected reduction for ignition delay values to a range of about 9 milliseconds to about 10 milliseconds depending on the percentage of DMAZ mixed with TMEDA.

An alternative compound includes a mixture of a hypergolic tertiary diamine such as TMEDA, and an amine azide such as tris(2-azidoethyl) amine (TAEA). Laboratory test data for unmixed TMEDA provides an ignition delay of about 14 milliseconds, and laboratory test data for unmixed TAEA provides an ignition delay of about 43 milliseconds. Combination of TMEDA and TAEA in a hypergolic liquid or gel fuel provides an unexpected reduction for ignition delay times to a range of about 8 milliseconds to about 9 milliseconds depending on percentage of TAEA mixed with TMEDA.

Additional combinations of chemical compounds to form a hypergolic fuel mixture include numerous cyclic amidine (also identified as imidic amide) compounds, such as 1,5-diazabicyclo(4.3.0)non-5-ene (hereinafter, DBN), mixed with a hypergolic tertiary diamine such as TMEDA, or a 1,8-Diazabicyclo(5.4.1) undec-7-ene (hereinafter, DBU), mixed with a hypergolic tertiary diamine such as TMEDA. A monocyclic analog of bi-cyclic DBN but having the non-nitrogen containing cyclic structure opened along with isomers thereof, are additional compounds utilized to form a hypergolic fuel mixture when mixed with a hypergolic tertiary diamine such as TMEDA. Compounds containing one or more tertiary tri-amine structures, such as N,N,N',N",N"-pentamethyldiethylenetriamine (hereinafter, PMDETA), and compounds containing tetra-amine, such as hexamethyl-triethylene-tetra-amine (HMETA), or larger amine structures, when mixed with amine azide or imidic amide compounds, are also capable of providing favorable short ignition delay values to serve as hypergolic fuel mixtures with minimal toxicity and lacking suspicion as a human carcinogen.

BRIEF DESCRIPTION OF THE DRAWINGS

The present invention is disclosed to include mixtures of chemicals referenced herein, with performance test results illustrated in graphs of ignition delay in milliseconds (msec) vs. % ratios of chemicals, including.

DETAILED DESCRIPTION OF THE INVENTION

Figure 5:
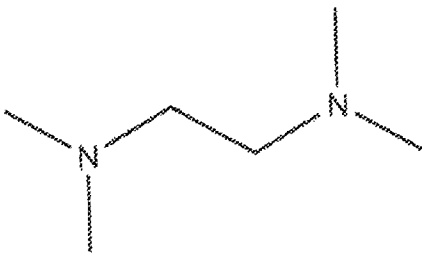
FIG. 5 depicts a structure for N,N,N',N',-tetramethylethylenediamine (TMEDA)
Figure 6:
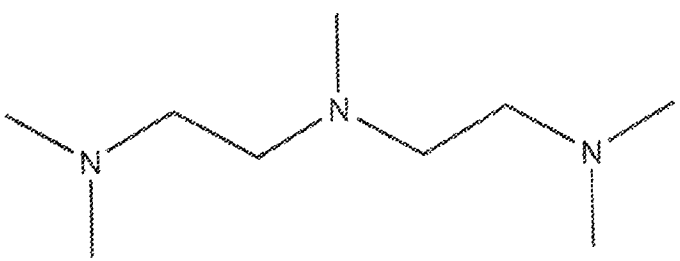
FIG. 6 depicts a structure for N,N,N",N"-pentamethyldiethylene-triamine (PMDETA)
Figure 7:
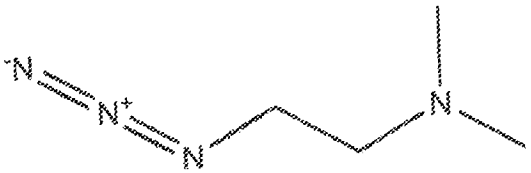
FIG. 7 depicts a structure for 2-N,N-dimethylaminoethylazide (DMAZ)
Figure 13:
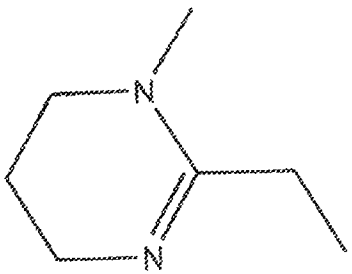
FIG. 13 depicts a structure for 1-methyl-2-ethyl-1,4,5,6-tetrahydro-pyrimidine.
Figure 9:
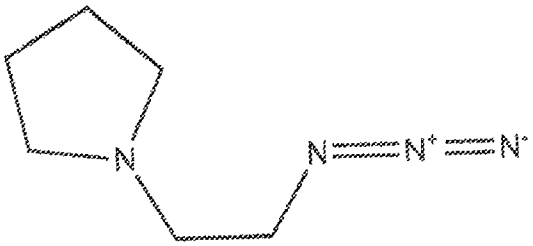
FIG. 9 depicts a structure for 2-(N-pyrrolidinyl)ethylazide (PYAZ)
Figure 12:
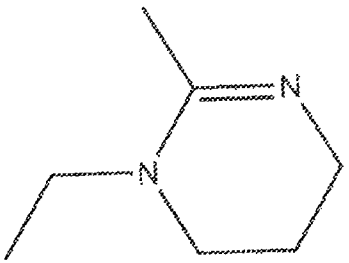
FIG. 12 depicts a structure for 1-ethyl-2-methyl-1,4,5,6-tetra-hydropyrimidine.
Figure 11:
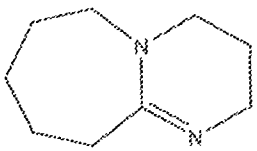
FIG. 11 depicts a structure for 1,8-diazabicyclo(5.4.1)undec-7-ene (DBU)
Figure 10:
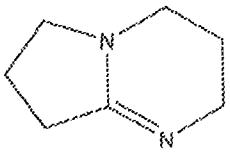
FIG. 10 depicts a structure for 1,5-diazabicyclo(4.3.0)non-5-ene (DBN)
Figure 8:
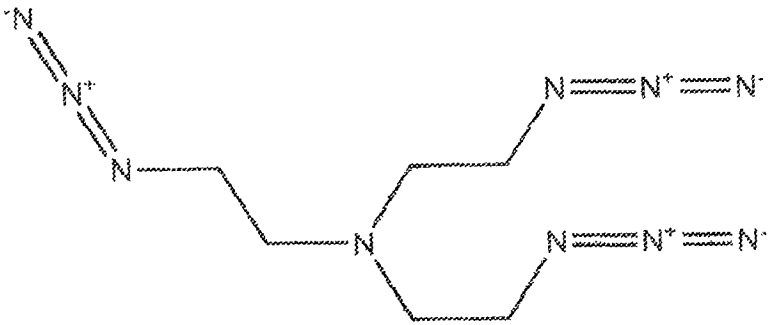
FIG. 8 depicts a structure for tris(2-azidoethyl) amine (TAEA)

Referring now to FIGS. 1-15, a plurality of mixtures of compounds are disclosed for use as hypergolic liquid or gel fuels in bipropellant propulsion systems. A plurality of combinations of amine azide compounds and tertiary diamine compounds are disclosed as providing suitable hypergolic bipropellant fuels with sufficiently short ignition delay times, including TMEDA (see FIG. 5) when mixed with one of the compounds of DMAZ (see FIG. 7), TAEA (see FIG. 8), PYAZ (see FIG. 9), BAZ, DBN (see FIG. 10), DBU (see FIG. 11), or monocyclic compounds similar to DBN. Also disclosed is the use of tertiary tri-amines such as PMDETA (see FIG. 6), to achieve sufficiently short ignition delay times when mixed with one or more of the compounds of DMAZ, TAEA, PYAZ, BAZ, DBU, DBN, or monocyclic compounds similar to DBN.

Previously disclosed alternative fuel compounds proposed for replacement of MMH in fuel, specifically DMAZ, BAZ and PYAZ mixed with IRFNA, have been investigated and found by laboratory drop testing of individual compounds to each provide significant longer ignition delays than that of MMH, as illustrated by data generated as a result of laboratory testing and provided in Table 1. Testing to determine ignition delay values of compounds was achieved using a laboratory drop test known to those skilled in the art involved in testing, such as drop testing utilized by the U.S. Army Research, Development and Engineering Command at the Redstone Arsenal, Ala., and government contractors including ERC, Incorporated, in Huntsville, Ala. The following ignition delay results for individual compounds are tested separately as mixtures with oxidant IRFNA, to allow comparisons with the ignition delay data for fuel mixtures in various combinations as disclosed herein (see FIGS. 1-4).

TABLE 1

Laboratory Drop Test/Ignition Delay of Hypergolic Fuels with IRFNA

| Compound | Ignition Delay (msec) |
|---|---|
| $MeNNH_2$ (MMH) | 8 |
| $Me_2NCH_2CH_2NMe_2$ (TMEDA) | 14 |
| $(CH_3)_2NCH_2CH_2N_3$ (DMAZ) | 26 |
| $—CH_2CH_2CH_2CH_2NCH_2CH_2N_3$ Pyrrolidinylethylazide (PYAZ) | 28 |
| Tris(2-azidoethyl)amine (TAEA) | 43 |
| $EtN(CHCH_2N_3)_2$ (BAZ) | 52 |

Fuel combinations of the present invention consist of one or more of a family of hypergolic amine azides or hypergolic imidic amide compounds (also referenced as a first component), mixed with one or more hypergolic tertiary diamine compound(s) (also referenced as a second component), and/or one or more tertiary tri- or tetra-amine compound(s) (an alternate second component). The hypergolic amine azides have the general structure $(R_1)(R_2)(R_3)N$, in which $R_1$, $R_2$, and $R_3$ is selected from the element of hydrogen, and an aliphatic, alkene, alkyne, or cycloalkyl group, any of which may or may not contain heteroatoms or heterocyclic atoms, but where at least one of the R groups selected contains an azide. The amine azides thus need not be tertiary amines and may have three azide-containing groups attached to the amine. The disclosed description of the amine azide differs from, and is broader than, that prior art relating to liquid or gel fuels, in which the disclosures of azides are limited to tertiary amine azides in which a maximum of two attached groups contain an azide. Examples of hypergolic amine azides defined by this invention include but are not limited to 2-(N,N-dimethylamino)ethylazide (DMAZ), 2-(N-cyclo-propylamino)ethylazide, bis(2-azidoethyl)methylamine, bis(2-azidoethyl)ethylamine (BAZ), tris(2-azidoethyl)amine (TAEA), 2-(N-pyrrolidinyl)ethylazide (PYAZ), N-(2-azidoethyl)morpholine, and 1,2-bis(N-(2-azidoethyl)-N-methylamino) ethane.

The tertiary diamines have the general formula $R_4R_5N—R_6—NR_7R_8$, where $R_4$, $R_5$, $R_7$, and $R_8$ are aliphatic groups and $R_6$ may be an aliphatic, alkene, or alkyne group. The hypergolic diamines include but are not limited to, N,N,N',N'-tetramethyl-ethylene-diamine (TMEDA), N,N,N',N'-tetramethyl-1,3-diaminopropane (TMPDA), N,N,N',N'-tetramethyl-1,4-diaminobutane (TMBDA), N,N,N',N'-tetramethyl-1,4-diaminobut-2-ene (cis or trans isomers or mixtures of cis/trans isomers), and N,N,N',N'-tetramethyl-1,4-diaminobut-2-yne.

The relative proportion of the hypergolic amine azide compound in the fuel may vary from about 1% to about 99%, and the proportion of the hypergolic tertiary diamine, tria-mine or tetra-amine compounds in the fuel may vary from about 1% to about 99% (dependent on amount of amine azide compound mixed wherewith). For optimal motor specific impulse and density specific impulse it is generally desirable to incorporate into the fuel the maximize percentage of amine azide compound which will still allow an acceptably low ignition delay of about 3 milliseconds to about 15 milliseconds. The tertiary diamine component of the fuel will optimally have a relatively short ignition delay when mixed with the oxidizer and have a relatively high content of tertiary amine groups in the molecule. An example of one embodiment is a fuel containing about 33.3% DMAZ and about 66.7% TMEDA (see FIG. 1), and providing an ignition delay of about 9.0 milliseconds. Illustrated in Table 1, laboratory drop ignition delay test results for a DMAZ and IRFNA mixture include ignition delay of about 26 milliseconds, and test results for a TMEDA and IRFNA mixture include ignition delay of about 14 milliseconds. The significantly shortened ignition delay times for DMAZ and TMEDA mixtures illustrated in FIG. 1 were not predictable from review of each component's physical structure or chemical composition.

Figure 1:
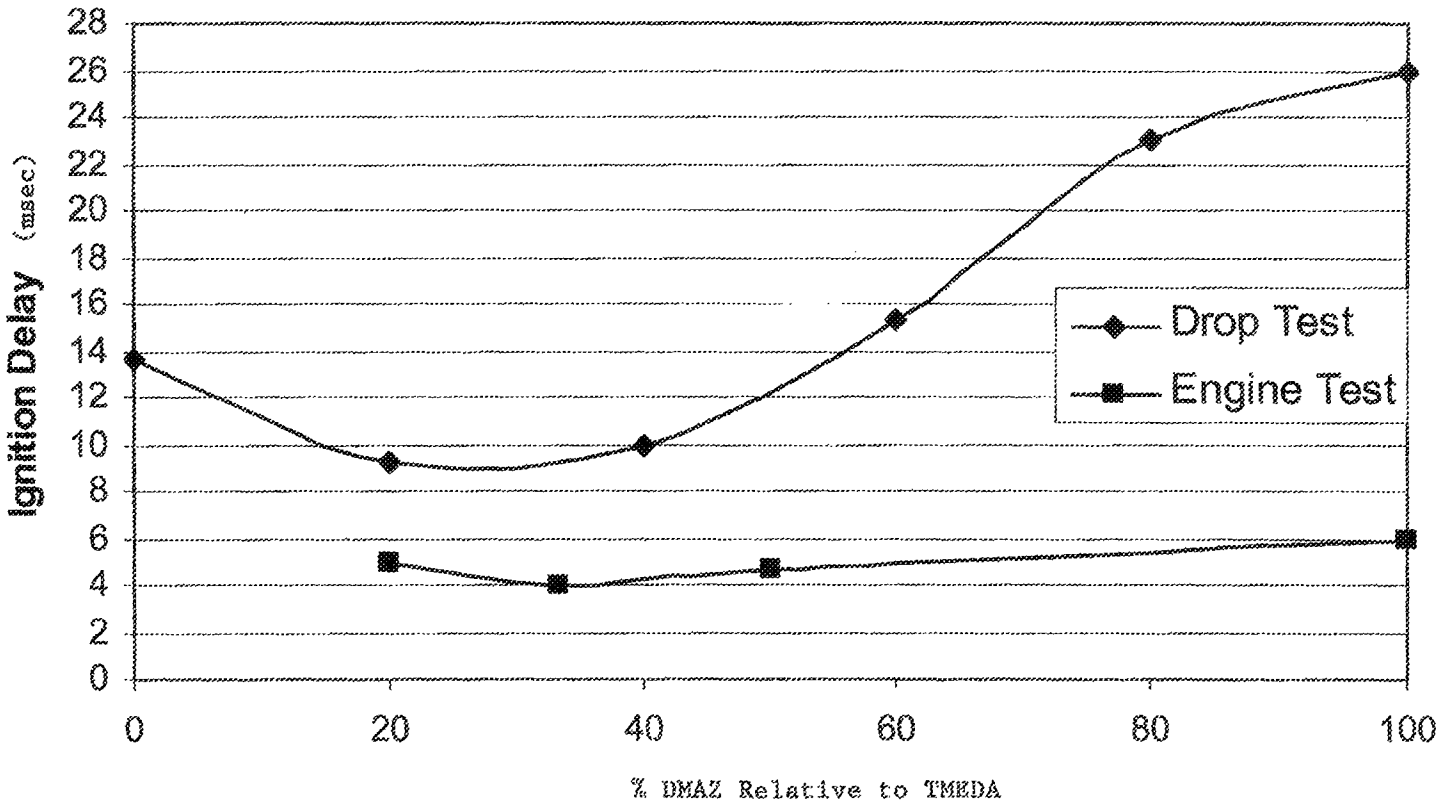
FIG. 1 is a graph of ignition delay time of DMAZ and TMEDA mixtures, relative to % content DMAZ for laboratory drop testing and engine testing.

An unexpected characteristic of the new fuel combinations is illustrated by the test data for shortened ignition delay times of mixtures of an amine azide and a tertiary amine as compared to test data for ignition delay times for either of the unmixed individual components. This synergistic effect of shortened ignition delay times is illustrated in FIG. 1 for mixtures of DMAZ and TMEDA, in FIG. 2 for mixtures of TAEA and TMEDA, in FIG. 3 for mixtures of DBN and TMEDA, and in FIG. 4 for DBN and PMDETA. As shown in FIG. 1, a fuel consisting of approximately 33.3% DMAZ mixed with approximately 66.7% TMEDA was tested in a rocket motor and provided successful motor ignition, as compared to rocket motor testing with pure DMAZ fuel which provide "hard starts." The calculated density specific impulse of approximately 33.3% DMAZ mixed with approximately 66.7% TMEDA is competitive with and generally identical to that calculated for MMH (12.6 lbf-sec/in$^3$). An additional benefit of the DMAZ and TMEDA mixture was that the fuel mixture burned cleaner with fewer residues than when pure TMEDA was used as the fuel.

A process for producing an improved hypergolic fuel mixture having shortened ignition delay times includes selecting an optimal proportion of DMAZ, a cyclic amine azide or an imidic amide compound, combined with a proportion of TMEDA or a tri- or tetra-amine, and further includes adding an oxidizer to the fuel mixture to initiate a reaction which is sufficiently exothermic to cause spontaneous ignition of the fuel in a propulsion system. The ignition delay is caused by several factors including production of sufficient heat by the initial oxidizer when mixed with the first component and second component to cause ignition of the fuel mixture. An ideal situation for fast ignition (i.e. shortened ignition delay) is one in which the fuel gives off a large amount of heat upon initial reaction with the oxidizer and also has a relatively low ignition temperature. In the two component mixture described herein, the amine azide (component one) releases a relatively low amount of heat upon initial reaction with an oxidizer because of its relatively low amine content and the relatively low basicity of the amine, therefore the amine azide has a relatively low ignition temperature. In contrast, the tertiary amine (component two) releases a greater amount of heat upon initial reaction with an oxidizer because of its relatively high amine content and its relatively high basicity, although the tertiary amine has a relatively high ignition temperature. A step of selecting appropriate first and second components, followed by adding the selected first and second components with an oxidizer in a propulsion system, allows the process to take advantage of the favorable characteristics of the first and second components, namely low ignition temperature of the amine azide, and high initial heat production of the tertiary amine.

Figure 2:
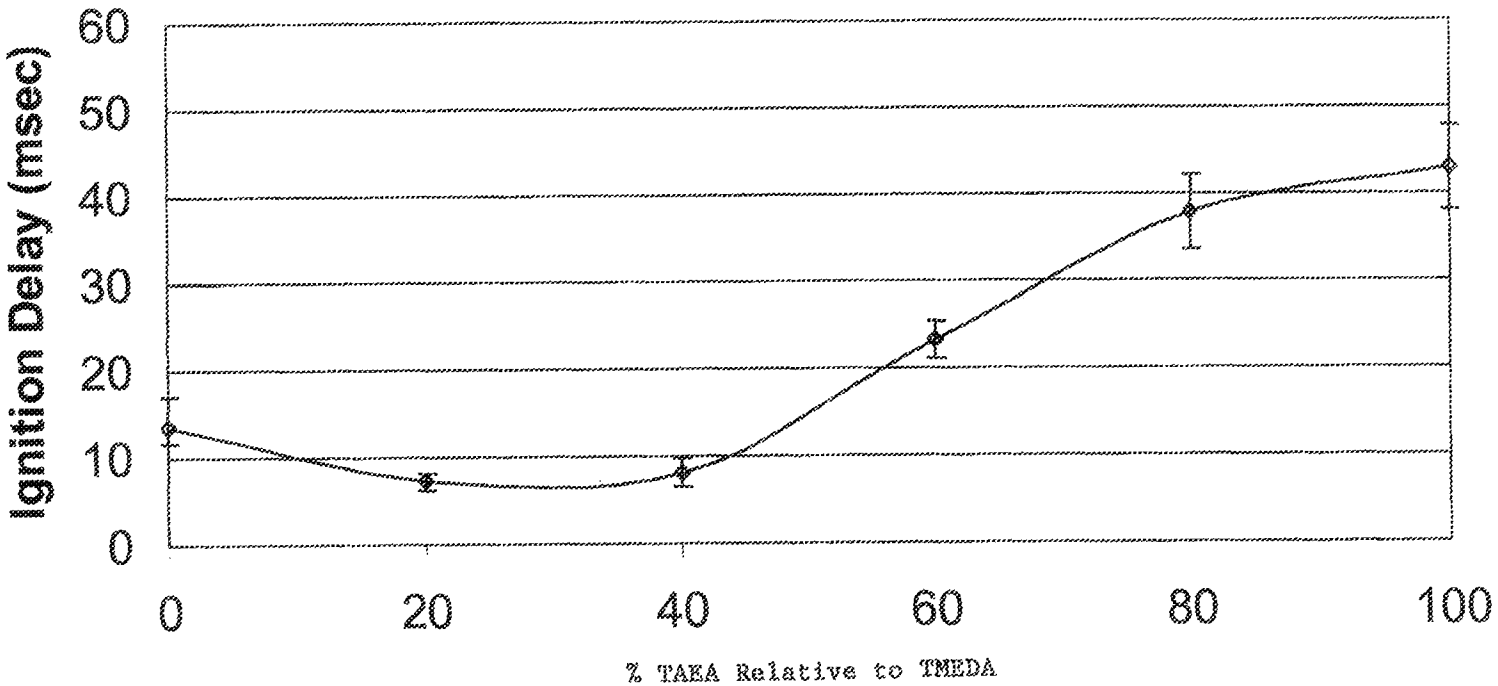
FIG. 2 is a graph of ignition delay times of TAEA and TMEDA mixtures, relative to % content of TAEA at about 30° C. for laboratory drop testing.

Examples of test results for proportions of TAEA compound as a first component of a hypergolic fuel mixture, when mixed with TMEDA compound as a second component are illustrated in FIG. 2. One embodiment of the fuel mixture is adding TAEA in the range of about 20% to about 40%, and adding TMEDA in the range of about 80% to about 60%, to provide a shortened ignition delay of about 9.0 milliseconds. Similar structured non-cyclic hypergolic amine azide compounds as first component of a hypergolic fuel mixture, which can be mixed with TMEDA include a compound selected from the group including the compounds of, 2-(N-cyclopropylamino)ethylazide, bis(2-azidoethyl)methylamine, bis(2-azidoethyl)ethylamine (BAZ), 2-(N-pyrrolidinyl)ethylazide (PYAZ), N-(2-azidoethyl)morpholine, and 1,2-bis(N-(2-azidoethyl)-N-methylamino)ethane.

Figure 3:
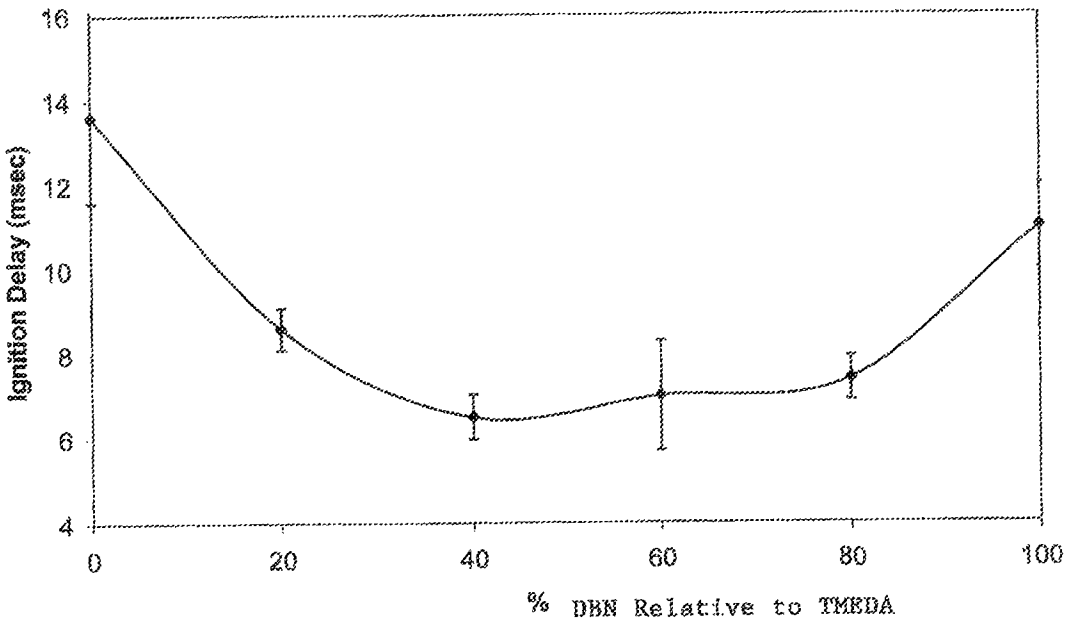
FIG. 3 is a graph of ignition delay times of DBN and TMEDA mixtures, relative to % content of DBN at about 30° C. for laboratory drop testing.

Examples of test results for proportions of a DBN cyclic compound used as a first component of a hypergolic fuel mixture, when mixed with TMEDA compound as a second component are illustrated in FIG. 3. One embodiment of the fuel mixture is adding DBN in the range of about 20% to about 80%, and adding TMEDA in the range of about 80% to about 20%, to provide a shortened ignition delay of between about 7.0 milliseconds and about 9.0 milliseconds. Similar structured bicyclic or monocyclic hypergolic amine azide or imidic amide compounds are utilized as a first component of a hypergolic fuel mixture. The imidic amide compounds include an amidine group of $(R_1)(R_2)$—N—$(R_3)$C═N—$(R_4)$, where the R substituents could be either hydrogen, alkyls or cycloalkyl groups. The $R_1$, $R_2$, and $R_4$ groups are attached to nitrogen atoms, and the $R_3$ group is attached to the carbon in the imidic amide compounds. As an example, DBN and DBU are bicyclic compounds in which the amidine group is contained within a ring composed of the $R_3$ and $R_4$ groups joining. The bicyclic or monocyclic amine azide or imidic amide compounds which can be combined in a mixture with TMEDA include a compound selected from the group of first component compounds of: 1,5-diazabicyclo(4.3.0)non-5-ene (DBN, see FIG. 10), 1,8-diazabicyclo(5.4.1) undec-7-ene (DBU, see FIG. 11), 1-ethyl-2-methyl-1,4,5,6-tetra-hydropyrimidine (see FIG. 12), 1-methyl-2-ethyl-1,4,5,6-tetrahydropyrimidine (see FIG. 13), 1-methyl-2-ethyl-4,5-dihydroimidazole (see FIG. 14), and 1-ethyl-2-methyl-4,5-dihydroimidazole (see FIG. 15). Any of the above group of first component compounds can be mixed with TMEDA (second component), in the form of a liquid for use as a fuel in a propulsion system. If a gelled fuel mixture is preferred, any of the disclosed group of first component compounds are mixed with TMEDA (second component), and mixed with an additive to create and maintain the mixture as a gel. The additive is added in proportions of between about 0.5% to about 10%, and selected from the group consisting of, silicon dioxide, clay, carbon, and/or polymeric gel, or similar additives utilized by those skilled in the art of maintaining a mixture as a gel.

Figure 4:
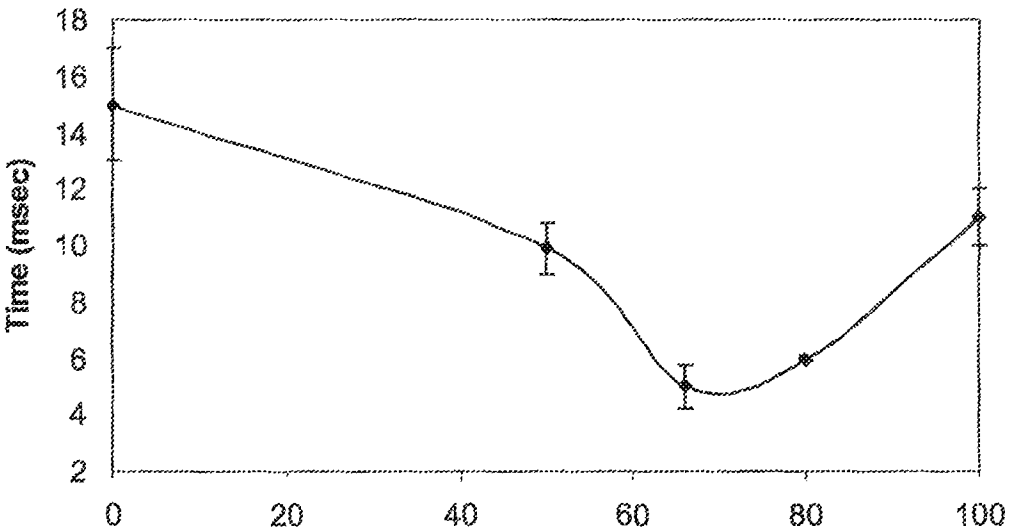
FIG. 4 is a graph of ignition delay times of DBN and PMDETA mixtures, relative to % content of DBN at about 30° C. for laboratory drop testing.
Figure 14:
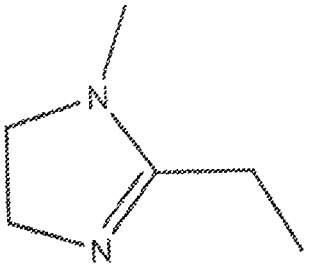
FIG. 14 depicts a structure for 1-methyl-2-ethyl-4,5-dihydroimidazole.
Figure 15:
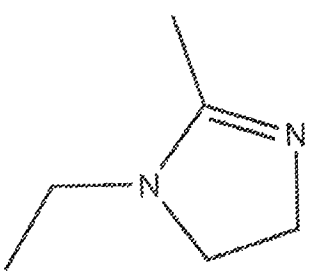
FIG. 15 depicts a structure for 1-ethyl-2-methyl-4,5-dihydroimidazole.

Any of the above described hypergolic amine azide compounds or imidic amide compounds as first components can be mixed with an alternative second component of N,N,N',N",N"-pentamethyldiethylenetriamine (PMDETA), to provide favorably short ignition delay times. One embodiment of the fuel mixture is illustrated in FIG. 4, providing DBN in the range of about 50% to about 90%, and adding PMDETA in the range of about 50% to about 10%, to provide shortened ignition delay times of between about 5.0 milliseconds and about 10.0 milliseconds. Additional embodiments for a hypergolic fuel mixtures include any of the above described hypergolic amine azide or imidic amide compounds mixed with an alternative second component of a tertiary tetra-amine such as hexamethyl-triethylene-tetra-amine (HMETA), or compounds having larger tertiary amine structures.

A source for inducing reaction of the first compound and the second compound is stored with the fuel propulsion system and is readily injected in the mixture of the first and second compound at a time when ignition of the first and second compound is required for proper operation of the propulsion system. The source for inducing reaction is an oxidizer selected from the group consisting of liquid oxygen, hydrogen peroxide, nitric acid, nitrogen dioxide and inhibited red fuming nitric acid (IRFNA).

Additives to a fluid mixture of first and second components are available for forming a gel mixture. The additive gellant is provided in the mixture in a proportion of between about 0.5% to about 10% additive selected from silicon dioxide, clay, carbon, and polymeric gel. The gelled fuel mixture can also include solid additives which improve the specific impulse and density specific impulse. The solid additives are known to those skilled in the art of rocket fuels and include, but are not limited to, carbon, aluminum, silicon, boron, tungsten, triamino-trinitrobenzene or tetramethyl-ammonium-mazide. The gelled fuel mixtures can include between about 1% to about 80% solid additives, between about 98.5% to about 10% amine azide and tertiary amine fuel mixtures in varying ratios (see FIGS. 1, 2, 3 and 4), and between about 0.5% to about 10% gellant. Liquid fuel mixtures have between about 98.5% to about 10% amine azide and diamine fuel mixtures and lack the gellant.

While numerous embodiments of mixtures of chemical compounds and processes for combining the chemical compounds for this invention are illustrated and disclosed herein, it will be recognized that various additional embodiments utilizing the primary chemicals of the invention may be employed without departing from the spirit and scope of the invention as set forth in the appended claims. Further, the disclosed invention is intended to cover all stereoisomer chemical compositions and alternate processes falling within the spirit and scope of the invention as set forth in the appended claims.

What is claimed is:

1. A hypergolic fuel mixture in a propulsion system comprising:

a first component including an amidine compound; and a second component including a hypergolic tertiary tetra amine compound;

whereby said first and second components form a liquid or gel fuel mixture in the propulsion system.

2. The hypergolic fuel mixture of claim 1, further comprising an oxidizer selected from the group consisting of inhibited red fuming nitric acid, nitrogen tetroxide, hydrogen peroxide, hydroxylammonium nitrate, and liquid oxygen.

3. The hypergolic fuel mixture of claim 1, wherein said second component includes hexamethyl-triethylene-tetra-amine.

4. The hypergolic fuel mixture of claim 1, wherein said amidine compound in said first component is selected from the group consisting of:

1,5-Diaza-bicyclo(4.3.0)non-5-ene;

1,8-Diaza-bicyclo(5.4.1)undec-7-ene;

1-ethyl-2-methyl-1,4,5,6-tetrahydropyrimidine;

1-methyl-2-ethyl-1,4,5,6-tetrahydropyrimidine;

1-ethyl-2-methyl-4,5-dihydroimidazole; and 1-methyl-2-ethyl-4,5-dihydroimidazole.

5. The hypergolic fuel mixture of claim 1, further comprising an additive gellant added to said first and second components in a proportion of between about 0.5% to about 10% additive relative to said first and second components thereby forming a gel fuel mixture, said additive gellant selected from the group consisting of silicon dioxide, clay, carbon, and polymeric gel.

6. A process for producing a hypergolic propellant utilizable in a fuel propulsion system comprising:

a step of adding a first component including an imidic amide compound;

a step of adding a second component including a hypergolic tertiary amine compound to said first component in a liquid or gel mixture; and a step of adding an oxidizer for inducing reaction of said first and second components in said liquid or gel mixture in the fuel propulsion system.

7. The process of claim 6 wherein said step of adding a first component includes a step of adding at least one imidic amide compound selected from the group consisting of:

1,5-Diaza-bicyclo(4.3.0)non-5-ene;

1,8-Diaza-bicyclo(5.4.1)undec-7-ene;

1-ethyl-2-methyl-1,4,5,6-tetrahydropyrimidine;

1-methyl-2-ethyl-1,4,5,6-tetrahydropyrimidine;

1-ethyl-2-methyl-4,5-dihydroimidazole;

1-ethyl-2-methyl-4,5-dihydroimidazole; and 1-methyl-2-ethyl-4,5-dihydroimidazole.

8. The process of claim 6 wherein said step of adding a second component includes a step of adding at least one tertiary amine compound selected from the group consisting of:

N,N,N',N'-tetramethylethylenediamine;
N,N,N',N'-tetramethyl-1,3-diamino-propane;
N,N,N'N'-tetramethyl-1,3-diamino-propane;
N,N,N',N'-tetramethyl-1,4-diamino-butane;
N,N,N',N'-tetramethyl-1,4-diaminobut-2-ene;
N,N,N',N'-tetramethyl-1,4-diaminobut-2-yne.

9. The process of claim 6 wherein said step of adding a second component further including an additional step of adding at least one tertiary triamine or tetra-amine compound selected from the group consisting of N,N,N',N",N"-pentamethyldiethylenetriamine, and hexamethyltriethylenetetraamine.

10. The process of claim 6 wherein said step of adding an oxidizer including said oxidizer selected from the group consisting of inhibited red fuming nitric acid, nitrogen tetroxide, hydrogen peroxide, hydroxylammonium nitrate, and liquid oxygen.

11. The process of claim 6 further comprising a step of adding an additive gellant to said first and second components in a proportion of between about 0.5% to about 10% additive relative to said first and second components thereby forming a gel fuel mixture, said additive gellant being selected from the group consisting of silicon dioxide, clay, carbon, and polymeric gel.

12. A method of using an amidine compound to produce a hypergolic propellant utilizable in a fuel propulsion system, the method comprising:

a step of adding a first component including an amidine compound;

a step of adding a second component including a hypergolic tertiary amine compound to said first component in a liquid or gel mixture; and a step of adding an oxidizer for inducing reaction of said first and second components in said liquid or gel mixture in the fuel propulsion system.

13. The process of claim 12 wherein said step of adding a first component includes a step of adding at least one amidine compound selected from the group consisting of:

1,5-Diaza-bicyclo(4.3.0)non-5-ene;
1,8-Diaza-bicyclo(5.4.1)undec-7-ene;
1-ethyl-2-methyl-1,4,5,6-tetrahydropyrimidine;
1-methyl-2-ethyl-1,4,5,6-tetrahydropyrimidine;
1-ethyl-2-methyl-4,5-dihydroimidazole;
1-ethyl-2-methyl-4,5-dihydroimidazole; and
1-methyl-2-ethyl-4,5-dihydroimidazole.

14. The process of claim 12 wherein said step of adding a second component includes a step of adding at least one tertiary amine compound selected from the group consisting of:

N,N,N',N'-tetramethylethylenediamine;
N,N,N',N'-tetramethyl-1,3-diamino-propane;
N,N,N'N'-tetramethyl-1,3-diamino-propane;
N,N,N',N'-tetramethyl-1,4-diamino-butane;
N,N,N',N'-tetramethyl-1,4-diaminobut-2-ene; and
N,N,N',N'-tetramethyl-1,4-diaminobut-2-yne.

15. The process of claim 12 wherein said step of adding a second component further including an additional step of adding at least one tertiary triamine or tetra-amine compound selected from the group consisting of N,N,N',N",N"-pentamethyldiethylenetriamine, and hexamethyltriethylenetetraamine.

16. The process of claim 12 wherein said step of adding an oxidizer including said oxidizer selected from the group consisting of inhibited red fuming nitric acid, nitrogen tetroxide, hydrogen peroxide, hydroxylammonium nitrate, and liquid oxygen.

17. The process of claim 12 further comprising a step of adding an additive gellant to said first and second components in a proportion of between about 0.5% to about 10% additive relative to said first and second components thereby forming a gel fuel mixture, said additive gellant being selected from the group consisting of silicon dioxide, clay, carbon, and polymeric gel.

18. A hypergolic liquid or gel utilized in a fuel propulsion system comprising:

a hypergolic fuel containing a mixture of a first component and a second component, the mixture including:

said first component including one or more hypergolic imidic amide compounds having a formula $(R_1)(R_2)$—N—$(R_3)$C═N—$(R_4)$, in which the composition of each $R_1$, $R_2$, $R_3$ and $R_4$ group is selected from the group consisting of hydrogen, aliphatic, alkene, alkyl, alkyne, and cycloalkyl groups, and each of $R_1$, $R_2$, and $R_4$ groups are attached to nitrogen groups;

said second component including hexamethyl-triethylene-tetra-amine; and an oxidizer mixed with said first component and said second component within the fuel propulsion system.

19. The hypergolic liquid or gel of claim 18 wherein said first component further includes a selected first proportion of said first component selected from the group consisting of, 1,5-Diaza-bicyclo(4.3.0)non-5-ene, 1,8-Diazabicyclo(5.4.1) undec-7-ene, 1-ethyl-2-methyl-1,4,5,6-tetra-hydropyrimidine, 1-methyl-2-ethyl-1,4,5,6-tetrahydropyrimidine, 1-methyl-2-ethyl-4,5-dihydroimidazole, and 1-ethyl-2-methyl-4,5-dihydroimidazole; and said second component further includes N,N,N',N",N"-pentamethyl-diethylenetriamine.

* * * * *